US008575509B2

(12) United States Patent
Marchand et al.

(10) Patent No.: US 8,575,509 B2
(45) Date of Patent: Nov. 5, 2013

(54) VACUUM SWITCHING APPARATUS INCLUDING FIRST AND SECOND MOVABLE CONTACT ASSEMBLIES, AND VACUUM ELECTRICAL SWITCHING APPARATUS INCLUDING THE SAME

(75) Inventors: Francois J. Marchand, Oakdale, PA (US); Stephen D. Mayo, Horseheads, NY (US); Wangpei Li, Horseheads, NY (US); Kesong Xie, Suzhou (CN); Brad R. Leccia, Bethel Park, PA (US); Martin B. J. Leusenkamp, Suzhou (CN)

(73) Assignee: Eaton Corporation, Cleveland, OH (US)

( * ) Notice: Subject to any disclaimer, the term of this patent is extended or adjusted under 35 U.S.C. 154(b) by 217 days.

(21) Appl. No.: 13/245,985

(22) Filed: Sep. 27, 2011

(65) Prior Publication Data

US 2013/0075368 A1 Mar. 28, 2013

(51) Int. Cl.
*H01H 33/66* (2006.01)

(52) U.S. Cl.
USPC ..... 218/126

(58) Field of Classification Search
USPC ..... 218/121–126, 139
See application file for complete search history.

(56) References Cited

U.S. PATENT DOCUMENTS

| | | | | |
|---|---|---|---|---|
| 2,965,734 | A | 12/1960 | Timmerman | |
| 3,211,866 | A * | 10/1965 | Crouch et al. | 218/126 |
| 3,814,882 | A * | 6/1974 | Harrold | 218/121 |
| 4,345,126 | A * | 8/1982 | Cherry et al. | 218/126 |
| 4,617,434 | A | 10/1986 | Zückler | |
| 5,149,362 | A * | 9/1992 | Okutomi et al. | 75/240 |
| 5,691,522 | A | 11/1997 | Schulman et al. | |
| 5,777,287 | A | 7/1998 | Mayo | |
| 5,793,008 | A | 8/1998 | Mayo et al. | |
| 5,804,788 | A | 9/1998 | Smith | |
| 7,605,581 | B2 * | 10/2009 | Taylor et al. | 324/750.09 |
| 2008/0197114 | A1 | 8/2008 | Anger et al. | |
| 2010/0102035 | A1 | 4/2010 | Piccoz et al. | |
| 2010/0243611 | A1 * | 9/2010 | Takahashi et al. | 218/139 |

FOREIGN PATENT DOCUMENTS

| | | | |
|---|---|---|---|
| CN | 2805059 | Y | 8/2006 |
| EP | 1 022 758 | A2 | 7/2000 |
| GB | 1 212 657 | A | 11/1970 |
| GB | 2 038 098 | A | 7/1980 |

OTHER PUBLICATIONS

Balseal® Engineering, Inc., PN 290-64 "BAL Contact™ Springs for Medium- and High-Voltage Switchgear", www.balseal.com, Sep. 28, 2007, 1 p.

European Patent Office, "International Search Report and Written Opinion", Sep. 24, 2012, 12 pp.

* cited by examiner

*Primary Examiner* — Truc Nguyen

(74) *Attorney, Agent, or Firm* — Eckert Seamans Cherin & Mellott, LLC; Kirk D. Houser

(57) ABSTRACT

A vacuum switching apparatus includes a vacuum envelope; a fixed contact assembly partially within the vacuum envelope; a first movable contact assembly partially within the vacuum envelope; a second movable contact assembly partially within the vacuum envelope; a first bellows within the vacuum envelope and cooperating with the first movable contact assembly to maintain a partial vacuum within the vacuum envelope; and a second bellows within the vacuum envelope and cooperating with the first movable contact assembly and the second movable contact assembly to maintain a partial vacuum within the vacuum envelope.

24 Claims, 10 Drawing Sheets

VACUUM SWITCHING APPARATUS INCLUDING FIRST AND SECOND MOVABLE CONTACT ASSEMBLIES, AND VACUUM ELECTRICAL SWITCHING APPARATUS INCLUDING THE SAME

BACKGROUND

1. Field

The disclosed concept pertains to vacuum switching apparatus, such as for example and without limitation, vacuum interrupters including a vacuum envelope. The disclosed concept also pertains to vacuum electrical switching apparatus.

2. Background Information

Vacuum interrupters include separable main contacts disposed within an insulated and hermetically sealed vacuum chamber. The vacuum chamber typically includes, for example and without limitation, a number of sections of ceramics (e.g., without limitation, a number of tubular ceramic portions) for electrical insulation capped by a number of end members (e.g., without limitation, metal components, such as metal end plates; end caps; seal cups) to form an envelope in which a partial vacuum may be drawn. The example ceramic section is typically cylindrical; however, other suitable cross-sectional shapes may be used. Two end members are typically employed. Where there are multiple ceramic sections, an internal center shield is disposed between the example ceramic sections.

Vacuum electrical switching apparatus, such as vacuum circuit interrupters (e.g., without limitation, vacuum circuit breakers; vacuum switches; load break switches), provide protection for electrical systems from electrical fault conditions such as, for example, current overloads, short circuits, and low level voltage conditions. Typically, vacuum circuit interrupters include a spring-powered or other suitable operating mechanism, which opens electrical contacts inside a number of vacuum interrupters to interrupt the current flowing through the conductors in an electrical system in response to abnormal conditions.

The main contacts of vacuum interrupters are electrically connected to an external circuit to be protected by the vacuum circuit interrupter by electrode stems, typically an elongated member made from high purity copper. Generally, one of the contacts is fixed relative to the vacuum chamber as well as to the external circuit. The fixed contact is mounted in the vacuum envelope on a first electrode extending through one end member. The other contact is movable relative to the vacuum envelope. The movable contact is mounted on a movable electrode axially slidable through the other end member. The movable contact is driven by the operating mechanism and the motion of the operating mechanism is transferred inside the vacuum envelope by a coupling that includes a sealed metallic bellows. The fixed and movable contacts form a pair of separable contacts which are opened and closed by movement of the movable electrode in response to the operating mechanism located outside of the vacuum envelope. The electrodes, end members, bellows, ceramic shell(s), and the internal shield, if any, are joined together to form the vacuum interrupter (VI) capable of maintaining a partial vacuum at a suitable level for an extended period of time.

With the wide acceptance of vacuum interruption technology in medium voltage switchgear, vacuum interrupters are being used in more and more demanding applications. One example is the ever increasing continuous current requirement. However, a high continuous current carrying capability is not easy to achieve, especially in an axial magnetic field (AMF) type VI, where the current is often forced into a relatively long circular path to generate the necessary axial magnetic field.

There is room for improvement in vacuum electrical switching apparatus.

There is also room for improvement in vacuum interrupters.

SUMMARY

These needs and others are met by embodiments of the disclosed concept, which provide a vacuum switching apparatus comprising a vacuum envelope, a fixed contact assembly partially within the vacuum envelope, a first movable contact assembly partially within the vacuum envelope, and a second movable contact assembly partially within the vacuum envelope.

In accordance with one aspect of the disclosed concept, a vacuum switching apparatus comprises: a vacuum envelope; a fixed contact assembly partially within the vacuum envelope; a first movable contact assembly partially within the vacuum envelope; a second movable contact assembly partially within the vacuum envelope; a first bellows within the vacuum envelope and cooperating with the first movable contact assembly to maintain a partial vacuum within the vacuum envelope; and a second bellows within the vacuum envelope and cooperating with the first movable contact assembly and the second movable contact assembly to maintain a partial vacuum within the vacuum envelope.

The first movable contact assembly may comprise a first movable contact and a first movable contact stem; the second movable contact assembly may comprise a second movable contact and a second movable contact stem; the first and second movable contacts may electrically engage the fixed contact assembly within the vacuum envelope in a first contact position; the second movable contact may electrically engage the fixed contact assembly within the vacuum envelope and the first movable contact may electrically disengage from the fixed contact assembly within the vacuum envelope in a second contact position; and the first and second movable contacts may electrically disengage from the fixed contact assembly within the vacuum envelope in a third contact position.

The first movable contact may be structured to provide an arcing contact; and the second movable contact may be structured to provide a current carrying contact.

The current carrying contact may be made of a first material having a first conductivity, a first permittivity and a first erosion resistance; the arcing contact may be made of a second different material having a second conductivity, a second permittivity and a second erosion resistance; the first conductivity may be greater than the second conductivity; the first permittivity may be less than the second permittivity; and the first erosion resistance may be less than the second erosion resistance.

As another aspect of the disclosed concept, a vacuum switching apparatus comprises: a vacuum envelope; a fixed contact assembly partially within the vacuum envelope; a first movable contact assembly partially within the vacuum envelope; a second movable contact assembly partially within the vacuum envelope; a first bellows within the vacuum envelope and cooperating with the first movable contact assembly to maintain a partial vacuum within the vacuum envelope; a second bellows within the vacuum envelope and cooperating with the first movable contact assembly and the second movable contact assembly to maintain a partial vacuum within the vacuum envelope; and an operating assembly cooperating with the first and second movable contact assemblies to provide one of a first contact position wherein the first and second movable contact assemblies electrically engage the fixed contact assembly within the vacuum envelope, a second contact position wherein the second movable contact assembly electrically engages the fixed contact assembly within the vacuum envelope and the first movable contact assembly is electrically disengaged from the fixed contact assembly within the vacuum envelope, and a third contact position wherein the first and second movable contact assemblies are electrically disengaged from the fixed contact assembly within the vacuum envelope.

The operating assembly may comprise a dual contact spring assembly outside of the vacuum envelope; the first movable contact assembly may comprise a first movable contact within the vacuum envelope and a first movable contact stem partially within the vacuum envelope; the second movable contact assembly may comprise a second movable contact within the vacuum envelope and a second movable contact stem partially within the vacuum envelope; the second movable contact may be concentric with the first movable contact; the second movable contact stem may be concentric with the first movable contact stem; the dual contact spring assembly may comprise a housing housing a first contact spring and a second contact spring; the second contact spring may be concentric with the first contact spring; the first contact spring may engage the first movable contact stem outside of the vacuum envelope; and the second contact spring may engage the second movable contact stem outside of the vacuum envelope.

A shunt may be electrically connected in parallel with the second bellows; the shunt may include a first resistance; the second bellows may include a second resistance; and the first resistance may be less than the second resistance.

The first contact position may provide a closed position of the vacuum switching apparatus; movement from the first contact position to the second contact position may provide a transition from conduction to arcing between the fixed contact assembly and the second movable contact assembly; movement from the third contact position to the second contact position may provide a transition from non-conduction to arcing between the fixed contact assembly and the second movable contact assembly; and the third contact position may provide an open position of the vacuum switching apparatus.

The first movable contact assembly may be disposed around the second movable contact assembly and may be structured to provide a current carrying contact within the vacuum envelope; the second movable contact assembly may be structured to provide an arcing contact within the vacuum envelope; the second movable contact assembly may comprise a magnetic field coil within the vacuum envelope, a movable contact stem partially within the vacuum envelope, and the arcing contact within the vacuum envelope, the magnetic field coil being between the movable contact stem and the arcing contact; and the fixed contact assembly may comprise a fixed contact within the vacuum envelope, a fixed contact stem partially within the vacuum envelope, and a magnetic field coil disposed between the fixed contact stem and the fixed contact within the vacuum envelope.

As another aspect of the disclosed concept, a vacuum electrical switching apparatus comprises: a vacuum switching apparatus comprising: a vacuum envelope, a fixed contact assembly partially within the vacuum envelope, a first movable contact assembly partially within the vacuum envelope, a second movable contact assembly partially within the vacuum envelope, a first bellows within the vacuum envelope and cooperating with the first movable contact assembly to maintain a partial vacuum within the vacuum envelope, a second bellows within the vacuum envelope and cooperating with the first movable contact assembly and the second movable contact assembly to maintain a partial vacuum within the vacuum envelope, and an operating assembly cooperating with the first and second movable contact assemblies to provide one of a first contact position wherein the first and second movable contact assemblies electrically engage the fixed contact assembly within the vacuum envelope, a second contact position wherein the second movable contact assembly electrically engages the fixed contact assembly within the vacuum envelope and the first movable contact assembly is electrically disengaged from the fixed contact assembly within the vacuum envelope, and a third contact position wherein the first and second movable contact assemblies are electrically disengaged from the fixed contact assembly within the vacuum envelope; and an operating mechanism structured to move the operating assembly in a first longitudinal direction and an opposite second longitudinal direction.

The operating assembly may comprise a longitudinal member structured to be moved in a first longitudinal direction and an opposite second longitudinal direction by the operating mechanism.

The operating mechanism may be a one-step operating mechanism structured to move the longitudinal member in one of the first and second longitudinal directions; and the operating assembly may further comprise a dual contact spring assembly structured to transition the first and second movable contact assemblies in two steps from either of: (a) the first contact position to the third contact position through the second contact position, or (b) the third contact position to the first contact position through the second contact position.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
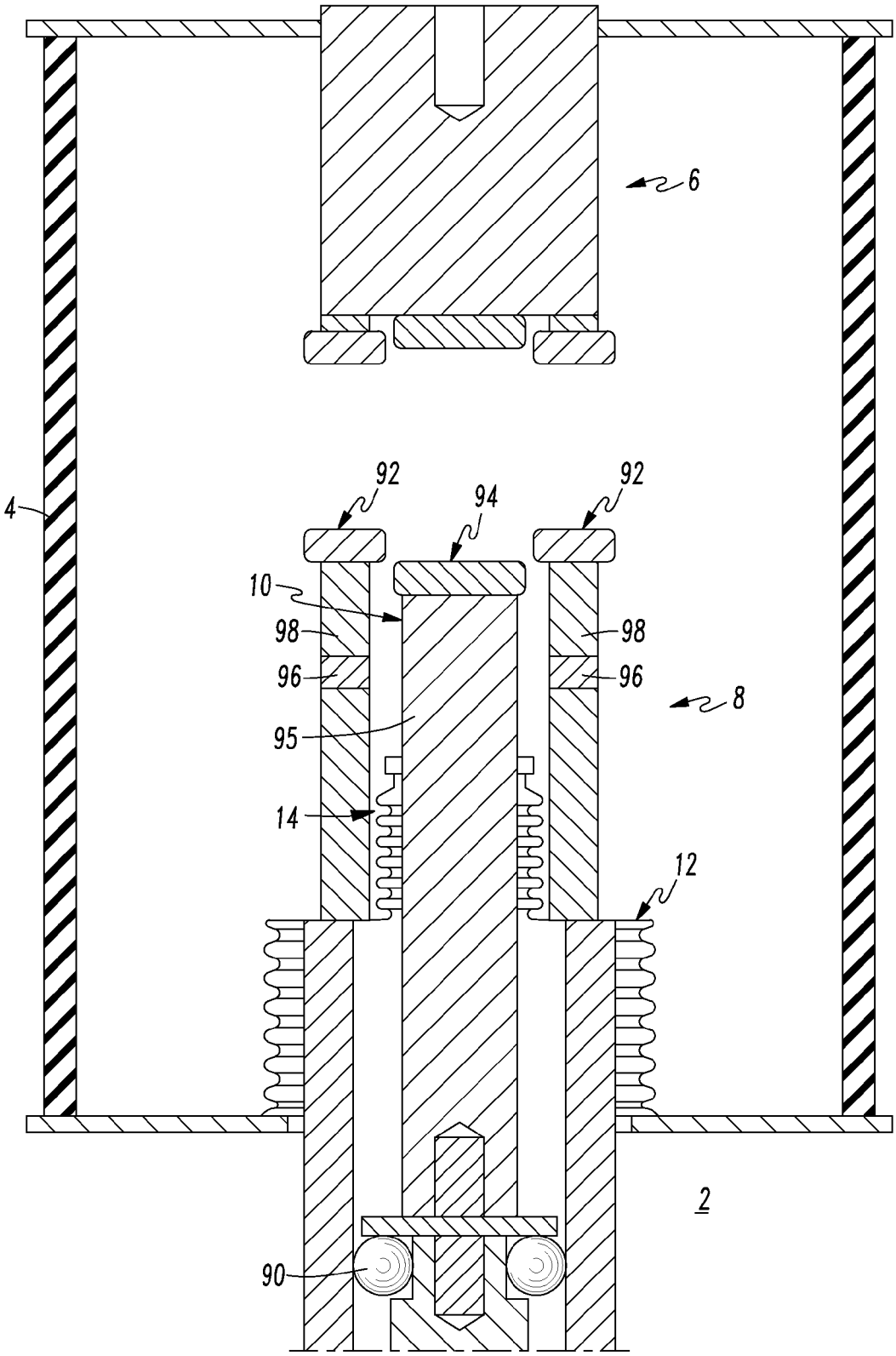
FIG. 1 is a vertical elevation sectional view of a vacuum switching apparatus in an open position in accordance with embodiments of the disclosed concept.
Figure 2:
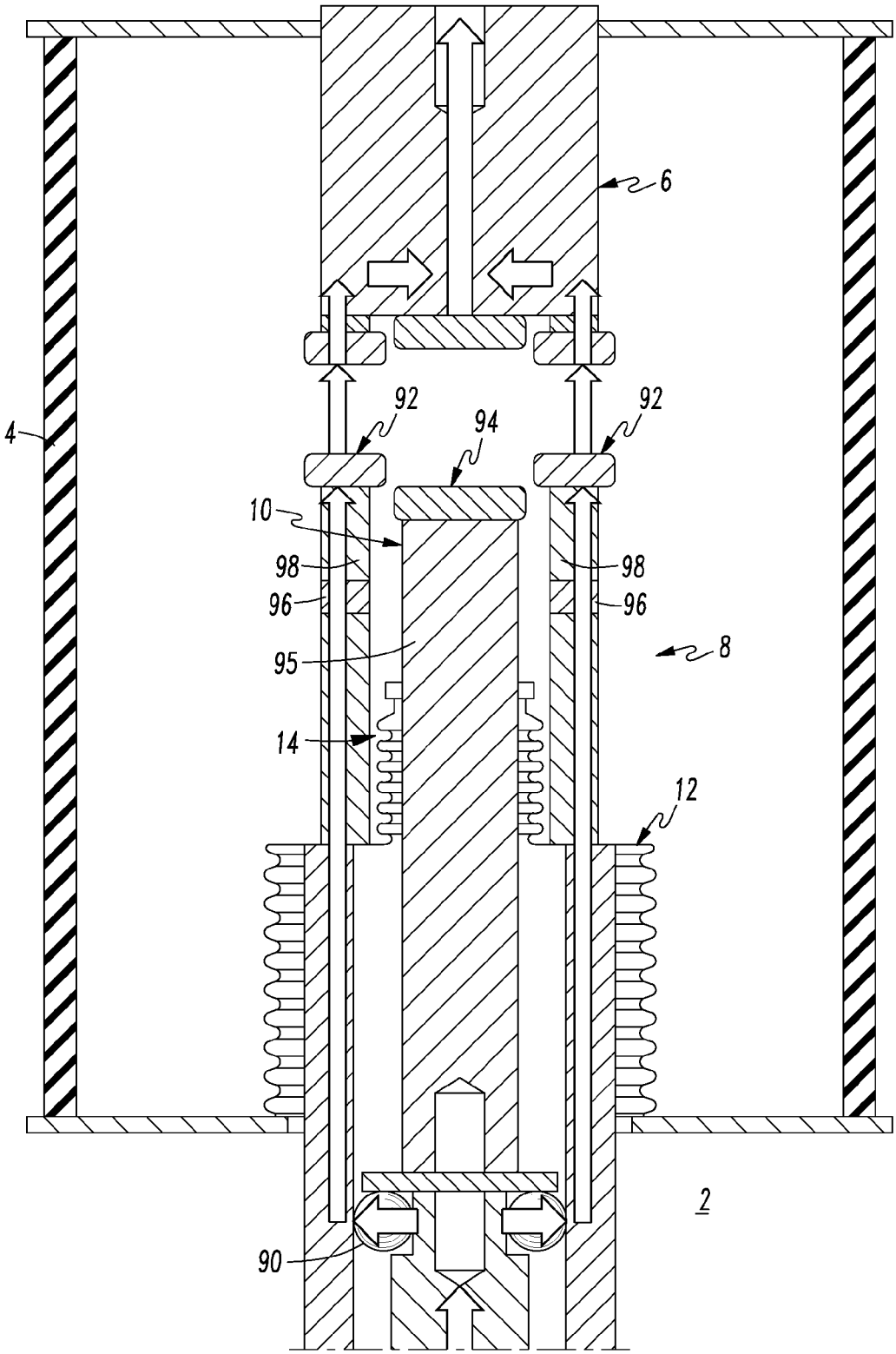
FIG. 2 is a vertical elevation sectional view of the vacuum switching apparatus of FIG. 1 showing arcing current flowing through the arcing contacts.
Figure 3:
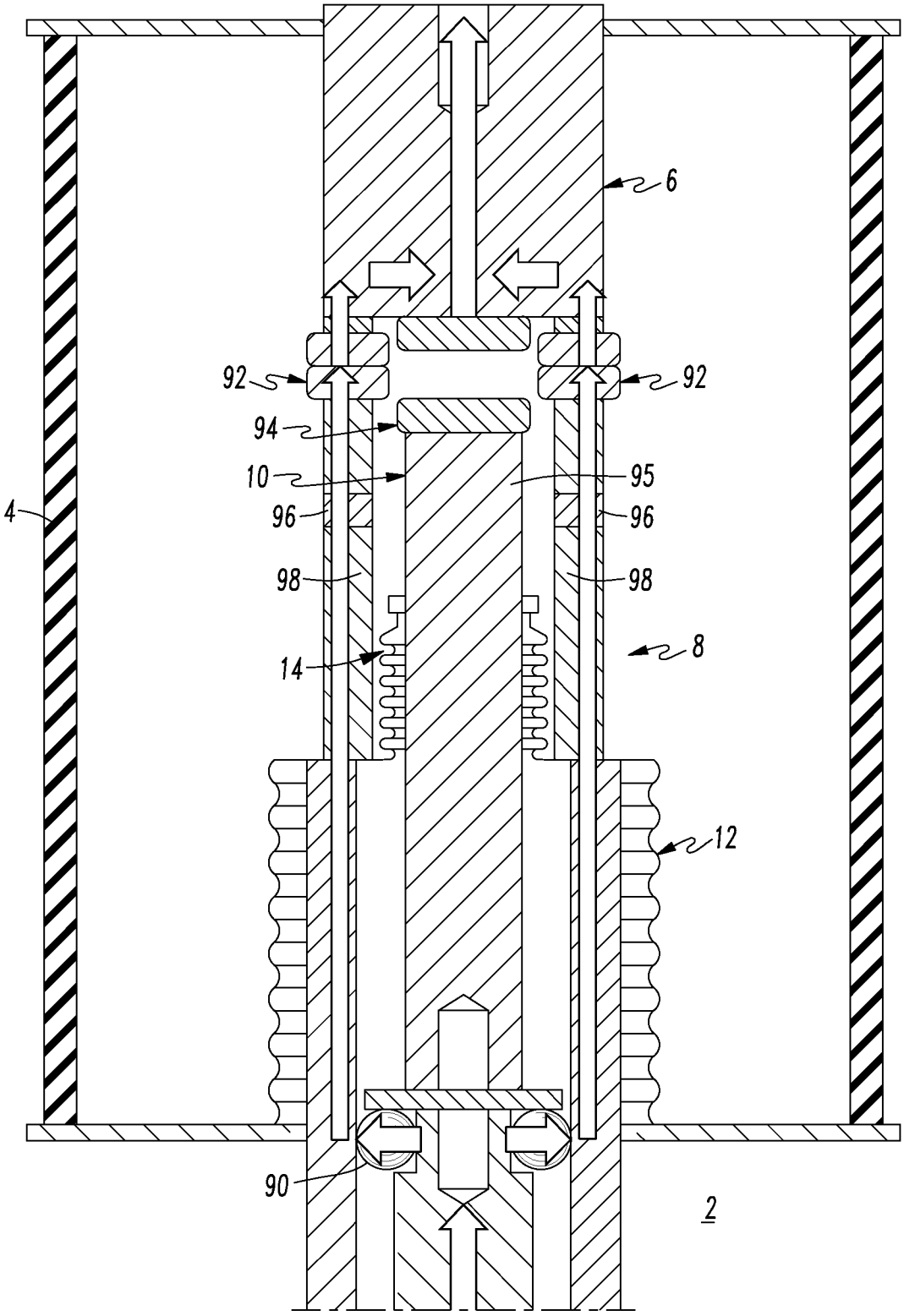
FIG. 3 is a vertical elevation sectional view of the vacuum switching apparatus of FIG. 1 showing current flowing through the arcing contacts in the closed position thereof.
Figure 4:
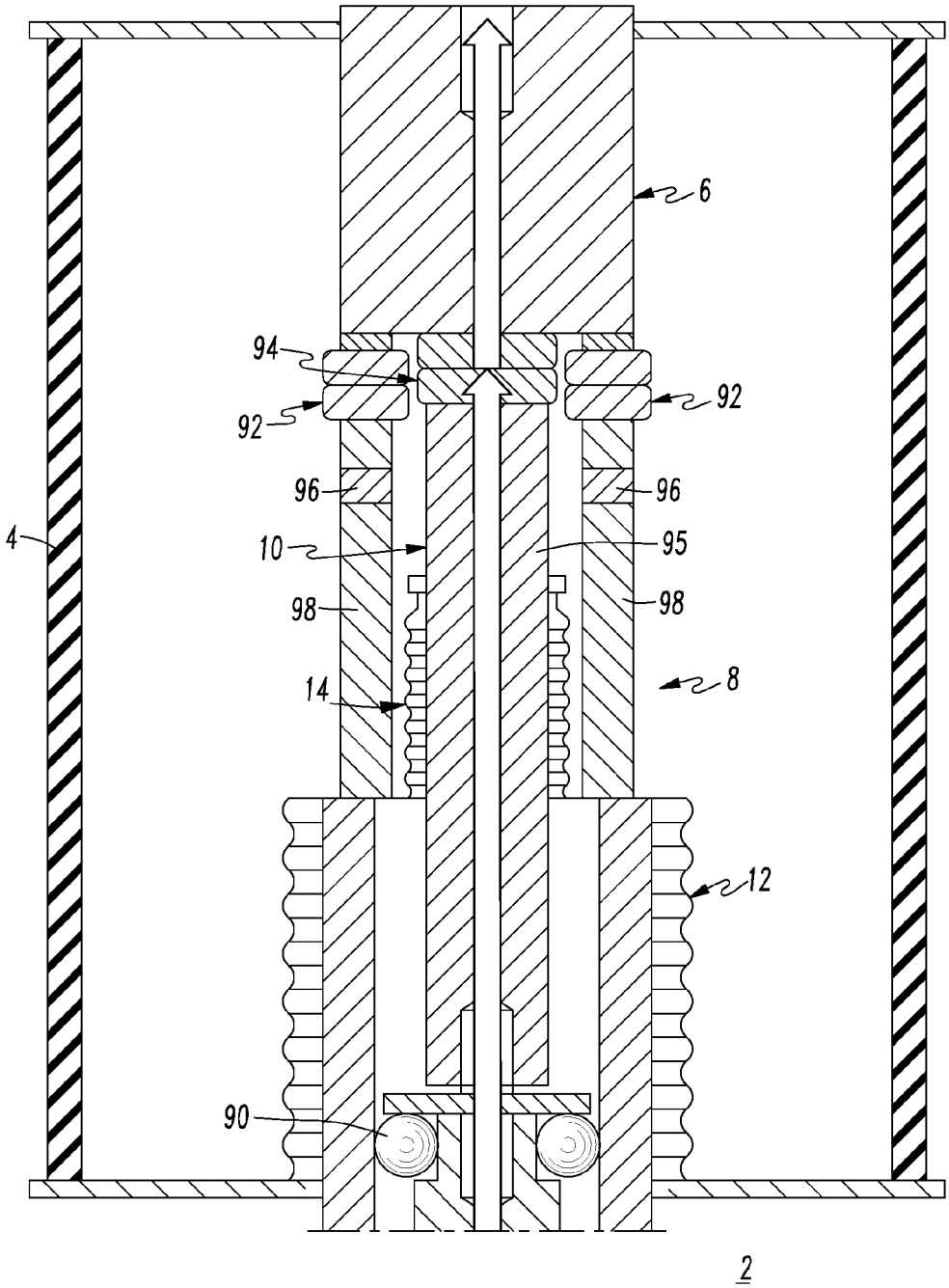
FIG. 4 is a vertical elevation sectional view of the vacuum switching apparatus of FIG. 1 in the closed position showing current flowing through the current carrying contacts.

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "vacuum envelope" means an envelope employing a partial vacuum therein.

As employed herein, the term "partial vacuum" means a space (e.g., within a vacuum envelope) partially exhausted (e.g., to the highest degree practicable; to a relatively high degree; to a degree suitable for use in a vacuum switching apparatus application) by a suitable mechanism (e.g., without limitation, an air pump).

As employed herein, the term "vacuum switching apparatus" shall mean a vacuum envelope employing a fixed contact, a first movable contact (e.g., without limitation, a current carrying contact) and a second movable contact (e.g., without limitation, an arcing contact). Non-limiting applications for a vacuum switching apparatus include a circuit breaker, an interrupter, a switch, a generator circuit breaker, a load break switch (LBS), a contactor, a low voltage (LV) switching apparatus, a medium voltage (MV) switching apparatus, a high voltage (HV) switching apparatus, and a vacuum electrical switching apparatus.

Referring to FIGS. 1-4, a vacuum switching apparatus 2 includes a vacuum envelope 4, a fixed contact assembly 6 partially within the vacuum envelope 4, a first movable contact assembly 8 partially within the vacuum envelope 4, and a second movable contact assembly 10 partially within the vacuum envelope 4. The example second movable contact assembly 10 is concentric with the first movable contact assembly 8, although other configurations are possible but may not be as economical and easy to implement with a simple mechanism. A first bellows 12 is within the vacuum envelope 4 and cooperates with the first movable contact assembly 8 to maintain a partial vacuum within the vacuum envelope 4. A second bellows 14 is within the vacuum envelope 4 and cooperates with the first and second movable contact assemblies 8,10 to maintain a partial vacuum within the vacuum envelope 4.

FIGS. 5-8 show another vacuum switching apparatus 22 including a vacuum envelope 24, a fixed contact assembly 26 partially within the vacuum envelope 24, a first movable contact assembly 28 partially within the vacuum envelope 24, and a second movable contact assembly 30 partially within the vacuum envelope 24. The example second movable contact assembly 30 is concentric with the first movable contact assembly 28, although other configurations are possible but may not be as economical and easy to implement with a simple mechanism. A first bellows 32 is within the vacuum envelope 24 and cooperates with the first movable contact assembly 28 to maintain a partial vacuum within the vacuum envelope 24. A second bellows 34 is within the vacuum envelope 24 and cooperates with the first and second movable contact assemblies 28,30 to maintain a partial vacuum within the vacuum envelope 24. The second bellows 34 is included for the relatively small gap 35 between the first and second movable contact assemblies 28,30.

An operating assembly 36 cooperates with the first and second movable contact assemblies 28,30 to provide one of a first contact position (FIG. 8) wherein the first and second movable contact assemblies 28,30 electrically engage the fixed contact assembly 26 within the vacuum envelope 24, a second contact position (FIG. 6 or 7) wherein the second movable contact assembly 30 electrically engages the fixed contact assembly 26 within the vacuum envelope 24 and the first movable contact assembly 28 is electrically disengaged from the fixed contact assembly 26 within the vacuum envelope 24, and a third contact position (FIG. 5) wherein the first and second movable contact assemblies 28,30 are electrically disengaged from the fixed contact assembly 26 within the vacuum envelope 24.

The first movable contact assembly 28 includes a first movable contact 38 within the vacuum envelope 24 and a first movable contact stem 40 partially within the vacuum envelope 24, which includes an opening 42. The first movable contact stem 40 passes through the vacuum envelope opening 42. The first bellows 32 includes a first end 44 coupled to the vacuum envelope 24 proximate the opening 42 thereof and a second end 46 coupled to the example stem 40 of the first and second movable contact stems 40,48 within the vacuum envelope 24.

The second movable contact assembly 30 includes a second movable contact 50 within the vacuum envelope 24 and the second movable contact stem 48 partially within the vacuum envelope 24. The example second movable contact 50 is concentric with the first movable contact 38, although other configurations are possible but may not be as economical and easy to implement with a simple mechanism. The example second movable contact stem 48 is concentric with the first movable contact stem 40, although other configurations are possible but may not be as economical and easy to implement with a simple mechanism. The second movable contact stem 48 passes through the vacuum envelope opening 42. The second bellows 34 includes a first end 52 coupled to the first movable contact stem 40 within the vacuum envelope 24 and a second end 54 coupled to the second movable contact stem 48 within the vacuum envelope 24.

Figure 5:
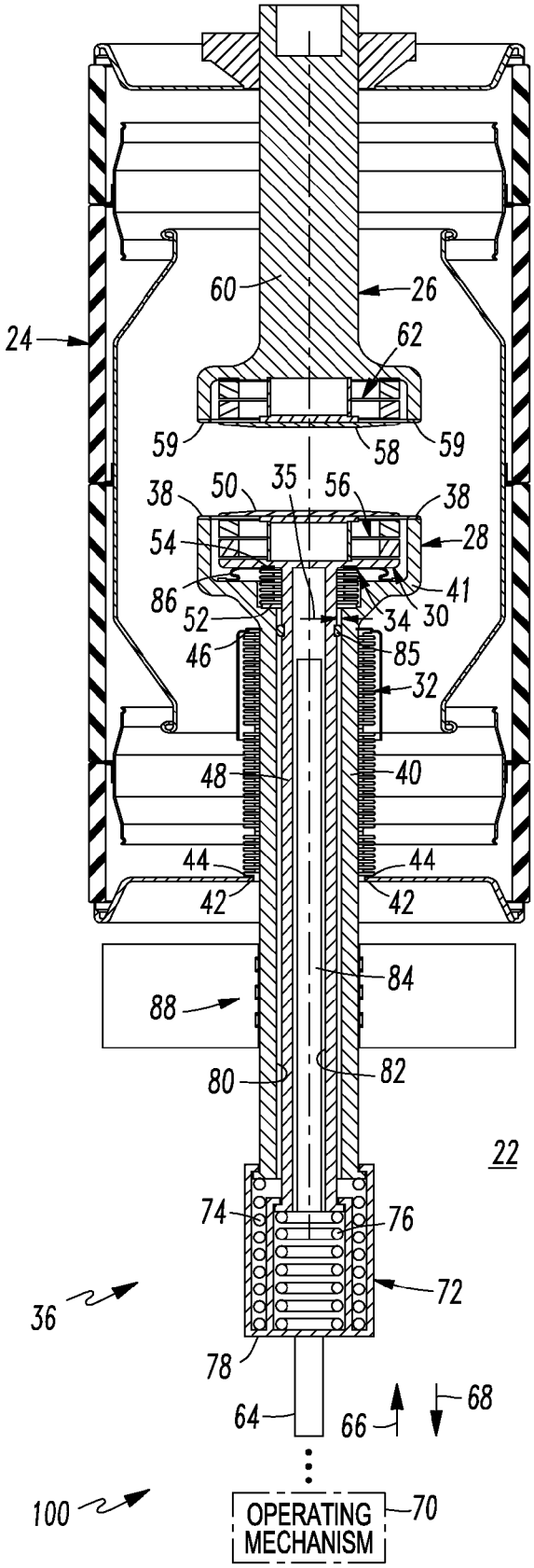
FIG. 5 is a vertical elevation sectional view of a vacuum electrical switching apparatus including a vacuum switching apparatus in an open position in accordance with another embodiment of the disclosed concept.
Figure 6:
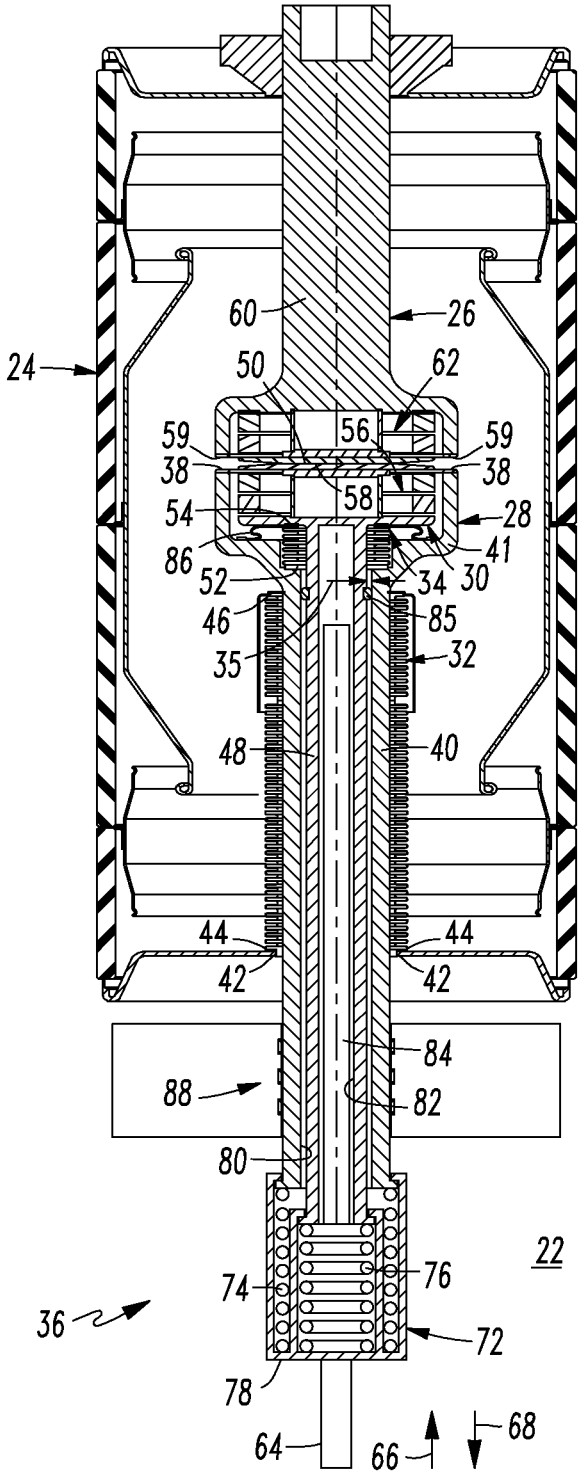
FIG. 6 is a vertical elevation sectional view of the vacuum switching apparatus of FIG. 5 in the initial closed position of the arcing contacts.
Figure 7:
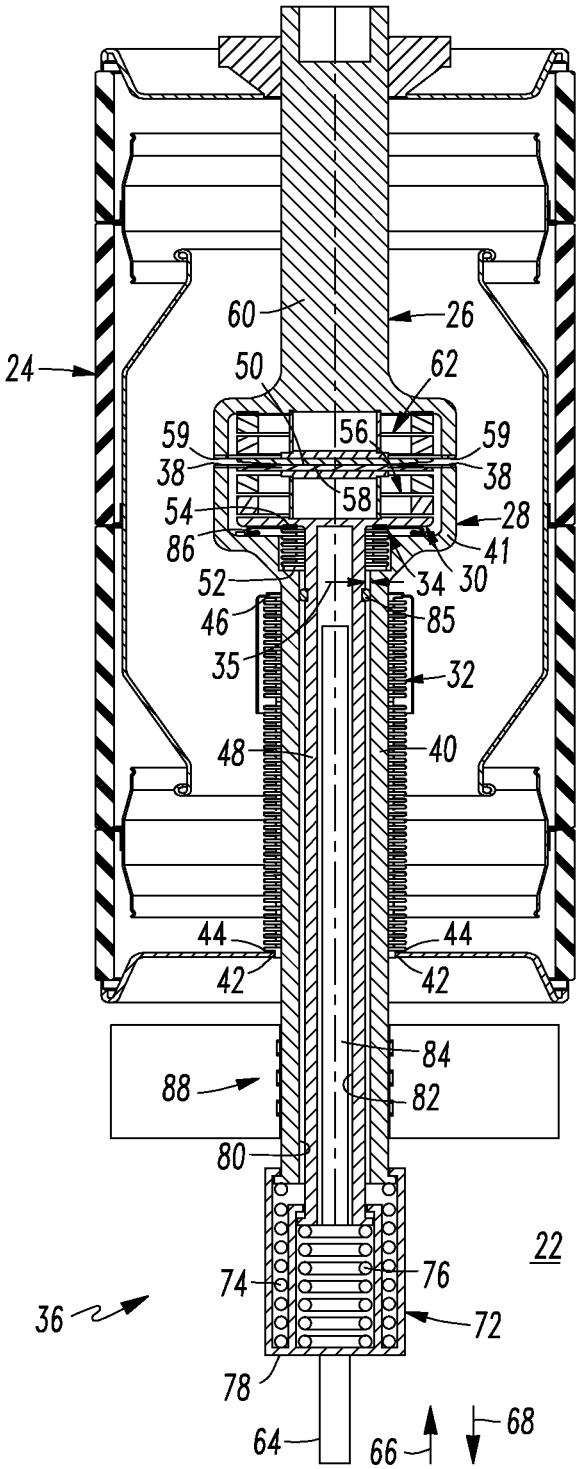
FIG. 7 is a vertical elevation sectional view of the vacuum switching apparatus of FIG. 5 in the final closed position of the arcing contacts.
Figure 8:
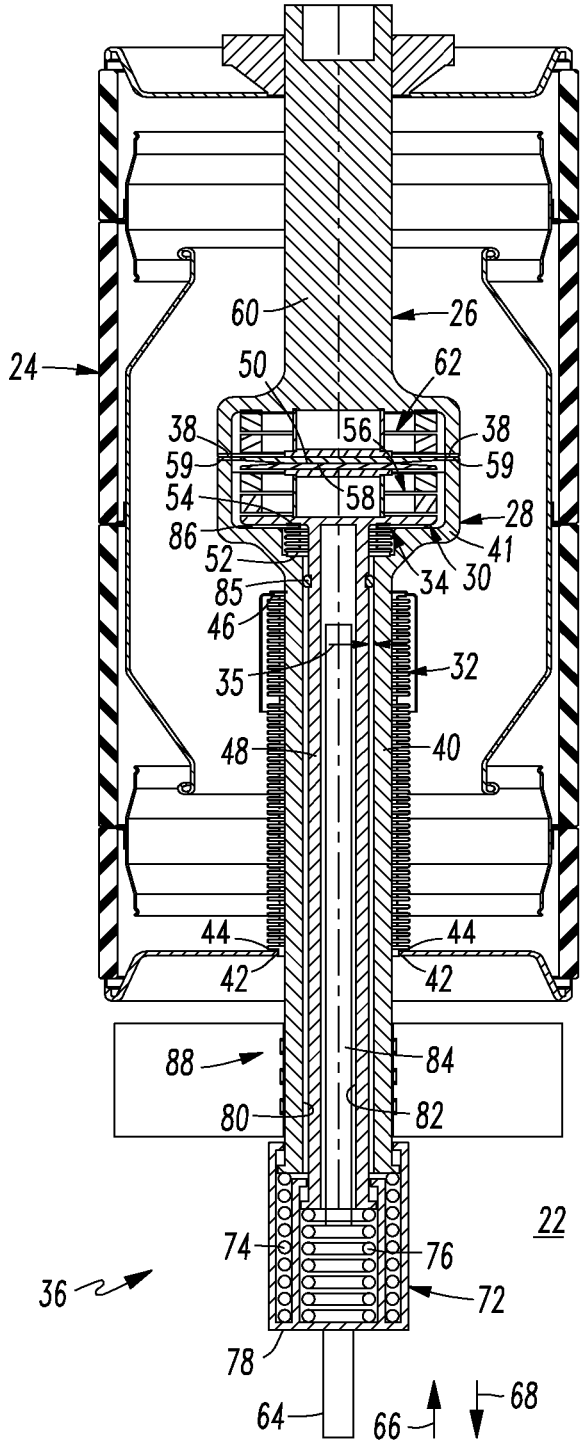
FIG. 8 is a vertical elevation sectional view of the vacuum switching apparatus of FIG. 5 in the closed position.

The first and second movable contacts 38,50 electrically engage the fixed contact assembly 26 within the vacuum envelope 24 in the first contact position (FIG. 8). The second movable contact 50 electrically engages the fixed contact assembly 26 within the vacuum envelope 24 and the first movable contact 38 is electrically disengaged from the fixed contact assembly 26 within the vacuum envelope 24 in the second contact position (FIG. 6 or 7). The first and second movable contacts 38,50 are electrically disengaged from the fixed contact assembly 26 within the vacuum envelope 24 in the third contact position (FIG. 5).

The first movable contact 38 is disposed around the second movable contact 50 and is structured to provide a current carrying contact 38. The second movable contact 50 is structured to provide an arcing contact 50.

The first contact position (FIG. 8) provides a closed position of the vacuum switching apparatus 22. Movement from the first contact position (FIG. 8) to the second contact position (FIG. 7) provides a transition from conduction to arcing between the fixed contact assembly 26 and the second movable contact assembly 30. Movement from the third contact position (FIG. 5) to the second contact position (FIG. 6) provides a transition from non-conduction to arcing between the fixed contact assembly 26 and the second movable contact assembly 30. The third contact position (FIG. 5) provides an open position of the vacuum switching apparatus 22.

The example current carrying contact 38 is made of a first material (e.g., without limitation, a CuCr mixture based alloy) having a first conductivity, a first permittivity and a first erosion resistance. The example arcing contact 50 is made of a second different material (e.g., without limitation, a CuCr mixture based alloy different from the first material) having a second conductivity, a second permittivity and a second erosion resistance. The first conductivity is greater than the second conductivity, the first permittivity is less than the second permittivity, and the first erosion resistance is less than the second erosion resistance.

The second movable contact assembly 30 includes a magnetic field coil 56 (e.g., without limitation, AMF; transverse magnetic field (TMF)) disposed between the second movable contact stem 48 and the second movable contact 50 within the vacuum envelope 24. The fixed contact assembly 26 includes a fixed contact 58 within the vacuum envelope 24, a fixed contact stem 60 partially within the vacuum envelope 24, and a magnetic field coil 62 (e.g., without limitation, AMF; TMF) disposed between the fixed contact stem 60 and the fixed contact 58 within the vacuum envelope 24.

The first movable contact assembly 28 is disposed around the second movable contact assembly 30 and is structured to provide the current carrying contact 38 within the vacuum envelope 24. The second movable contact assembly 30 is structured to provide the arcing contact 50 within the vacuum envelope 4.

The operating assembly 36 includes a longitudinal member, such as the example push (pull) rod 64 structured to be moved in a first longitudinal direction 66 (e.g., up with respect to FIGS. 5-7) and an opposite second longitudinal direction 68 (e.g., down with respect to FIG. 8) by an operating mechanism 70 (shown in phantom line drawing). The operating mechanism 70 is a one-step operating mechanism structured to move the push (pull) rod 64 in one of the first and second longitudinal directions 66,68. The operating assembly 36 further includes a dual contact spring assembly 72 structured to transition the first and second movable contact assemblies 28,30 in two steps from either of: (a) the first contact position (FIG. 8) to the third contact position (FIG. 5) through the second contact position (FIGS. 7 and 6), or (b) the third contact position (FIG. 5) to the first contact position (FIG. 8) through the second contact position (FIGS. 6 and 7).

The dual contact spring assembly 72 is outside of the vacuum envelope 24 and includes a first contact spring 74 and a second contact spring 76. The first contact spring 74 engages the first movable contact stem 40 outside of the vacuum envelope 24, and the second contact spring 76 engages the second movable contact stem 48 outside of the vacuum envelope 24. The dual contact spring assembly 72 includes a housing 78 housing the first and second contact springs 74,76. The example second contact spring 76 is concentric with the first contact spring 74, although other configurations are possible but may not be as economical and easy to implement with a simple mechanism. The first movable contact stem 40 includes a first longitudinal opening 80 therethrough, and the second movable contact stem 48 includes a second longitudinal opening 82 therethrough. The second movable contact stem 48 is disposed in the first longitudinal opening 80, and a heat pipe 84 is disposed in the second longitudinal opening 82. The heat pipe 84 is a heat-transfer device that combines the principles of both thermal conductivity and phase transition to efficiently manage the transfer of heat between two solid interfaces. At the hot interface within a heat pipe, which is typically at a relatively very low pressure, a liquid in contact with a thermally conductive solid surface turns into a vapor by absorbing heat from that surface. The vapor condenses back into a liquid at the cold interface, releasing the latent heat. The liquid then returns to the hot interface through either capillary action or gravity action where it evaporates once more and repeats the cycle. In addition, the internal pressure of the heat pipe can be set or adjusted to facilitate the phase change depending on the demands of the working conditions of the thermally managed system.

As shown in FIGS. 7 and 8, the two contact springs 74 and 76 of the example dual contact spring assembly 72 provide a force or pressure on the corresponding separable contacts 38,59 and 50,58. This reduces the resistance between the two corresponding contact surfaces and helps to prevent such corresponding separable contacts from moving when a short circuit current is applied. The contact springs 74,76 may also allow for the operating mechanism 70 to over-travel after such corresponding separable contacts touch; however, this is not their main intended function. After the example central arcing contacts 50,58 initially touch in FIG. 6, the relatively smaller, central contact spring 76 begins to compress, as shown in FIG. 7. Then, as shown in FIG. 8, the relatively smaller, central contact spring 76 continues to compress and the relatively larger, outer contact spring 74 also compresses until the outer carrying contacts 38,59 touch, as shown.

As shown in FIGS. 5-8, a number of washers 85 (e.g., without limitation, a bearing washer; a one-coil spring washer) is placed into the gap 35 between the movable contact stems 40,48 in order to the maintain concentricty during movement between the open position, the closed position of the arcing contacts, and the closed position.

A shunt 86 (best shown in FIG. 9) is preferably electrically connected in parallel with the second bellows 34. The shunt 86 includes a first resistance. The second bellows 34 includes a second greater resistance. The example shunt 86 is a parallel electrical connection 86 preferably provided for the second bellows 34 between a cup portion 41 of the first movable contact stem 40 and the magnetic field coil 56, and the second movable contact stem 48. This parallel electrical connection 86 preferably has several orders of magnitude lower electric resistance than that of the second bellows 34, thereby effectively reducing the current flowing through the second bellows 34. Preferably, the second bellows 34 is made from a suitable conductive material that can withstand relatively high current flow without sacrificing mechanical life. Preferably, the parallel electrical connection 86 provides the desired current carrying capability, and the second bellows 34 provides for mechanical transfer of motion and vacuum sealing.

The example parallel electrical connection 86 is a copper braided flexible band, but other suitable flexible electrical connections are possible, as long as they have relatively very low electrical resistance. The example copper braided flexible band is suitably attached (e.g., without limitation, brazed; welded) to the magnetic field coil 56 and to the cup portion 41 at both ends, in order that there are no separable contacts and, hence, no corresponding contact resistance.

Figure 9:
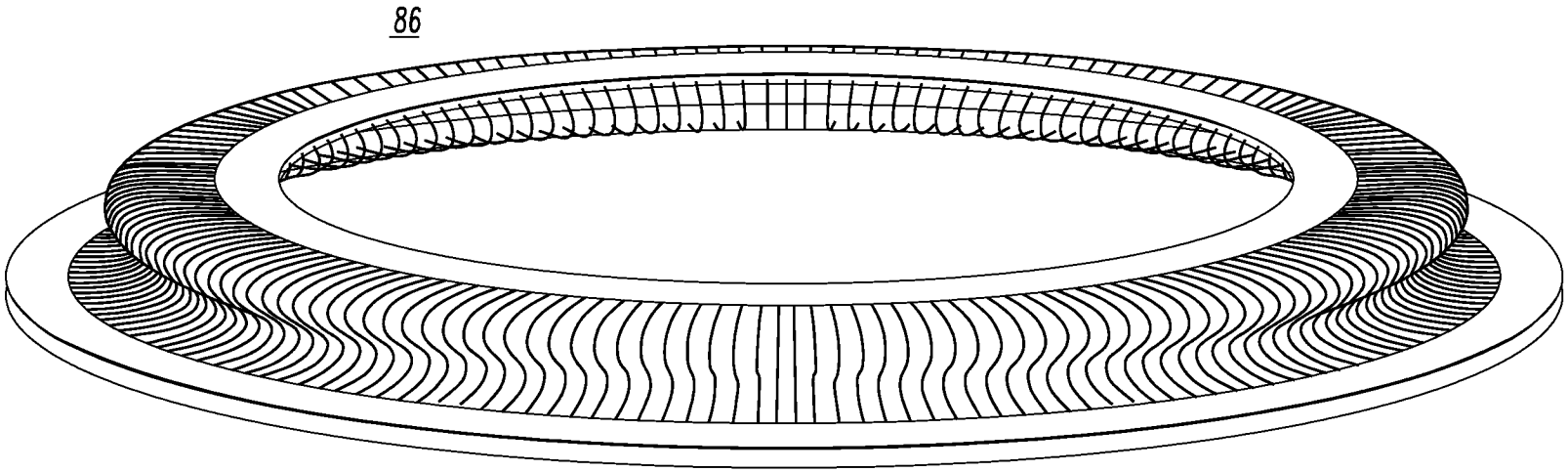
FIG. 9 is an isometric view of a shunt for electrical connection in parallel with the second bellows of FIG. 5.

With the example parallel electrical connection 86, there will still be a finite fraction of current flowing through the second bellows 34. Given the relatively very confined space (best shown in FIG. 8) between the magnetic field coil 56 and the cup portion 41, and a relatively small stroke (see, for example, FIGS. 6, 7 and 8) (e.g., without limitation, about 5 mm), the second bellows 34 can be, for example and without limitation, an edge-welded diaphragm bellows or a hydroformed bellows. An edge-welded diaphragm bellows can have relatively thicker walls, a relatively longer life and a relatively higher stroke/bellows-length ratio. Preferably, the electrical resistance of the second bellows 34 is relatively high when employed in combination with the example parallel electrical connection 86. The internal current transfer can be done with relatively thicker flexible parts and not only with a relatively thin copper shunt 86 as shown in FIG. 9.

Referring again to FIGS. 1-4, the first movable contact assembly 8 is disposed around the second movable contact assembly 10 and is structured to provide a first movable contact or arcing contact 92. The second movable contact assembly 10 is structured to provide a second movable contact or current carrying contact 94 carried by a second movable contact stem 95. The first movable contact assembly 8 includes a magnetic field coil 96 (e.g., without limitation, AMF; TMF) disposed in a first movable contact stem 98 carrying the first movable contact 92 disposed around the second movable contact 94.

The operating assembly 36 of FIG. 5 also includes an electrical connection, such as a slidable contact 88 (e.g., without limitation, a sliding contact), a ball seal 90 (FIG. 1), or a flexible electrical joint (not shown) (e.g., without limitation, a braided joint; a brazed copper joint; a flexible joint; a flexible electrical joint that moves about 60 mm), structured to provide an electrical connection to one of the first and second movable contact stems 40; 95,98 outside of the vacuum envelope 24; 4.

As shown in FIG. 5, the vacuum switching apparatus 22 and the operating mechanism 70 form a vacuum electrical switching apparatus 100.

It will be appreciated that the operating assembly 36 and the dual contact spring assembly 72 can generally be employed with the vacuum switching apparatus 2 of FIGS. 1-4. However, since the outer arcing contact 92 surrounds the central current carrying contact 94 (FIGS. 1-4), the contact springs 74,76 would be modified to provide a relatively smaller spring force of the outer contact spring 74 (FIG. 5) for the outer arcing contact 92, and a relatively larger spring force of the central contact spring 76 (FIG. 5) for the central current carrying contact 94.

Figure 10:
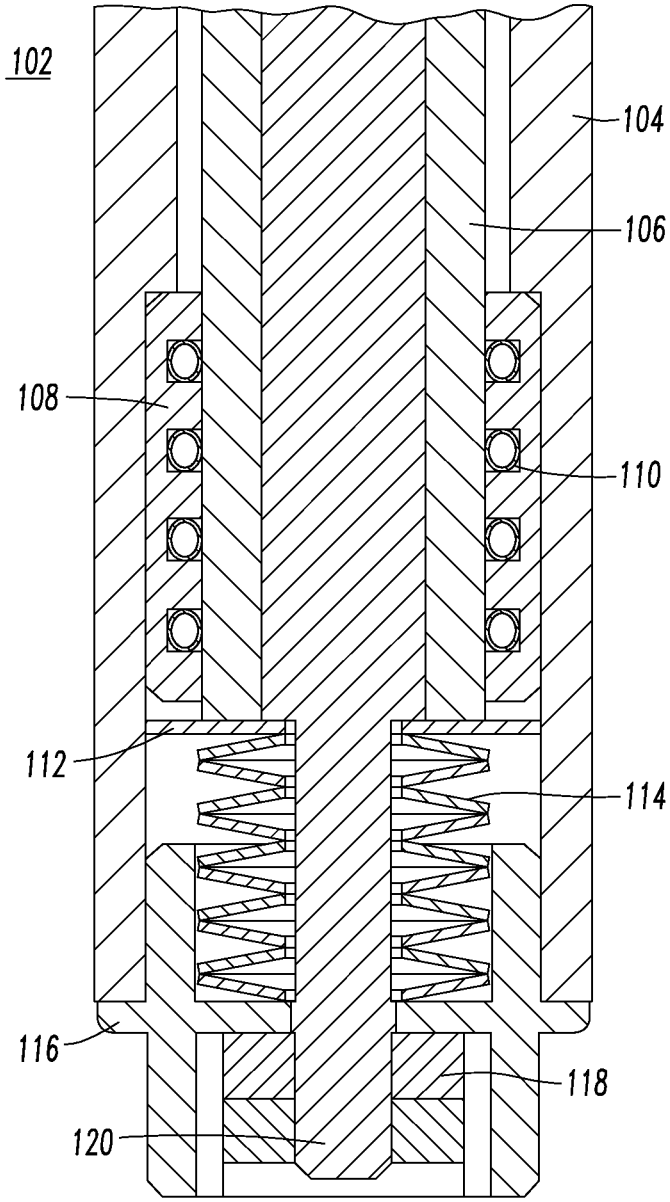
FIG. 10 is a vertical elevation sectional view of a movable terminal for the vacuum switching apparatus of FIG. 5.

Referring to FIG. 10, a movable terminal 102 can replace the operating assembly 36 of FIGS. 5-8. The movable terminal 102 includes an external electrode 104 (e.g., first movable contact stem 40), internal electrode 106 (e.g., second movable contact stem 48), a sliding contact 108, a BAL CONTACT™ spring 110, a stop washer 112, a disc spring 114, a connector 116, a bolt 118, and a movable stem 120.

During assembly, after the vacuum switching apparatus 22 is brazed and exhausted, the sliding contact 108 is screwed in, the spring 110 is put in place, as shown, and the stop washer 112 and the disc spring 114 are installed. Next, the connector 116 is screwed to compress the disc spring 114, in order to add pre-compact force on the discs (not shown) of the disc spring 114. Then, the bolt 118 is installed, in order to lock the internal electrode 106 and the connector 116. The connector 116 is, in turn, connected to the push (pull) rod 64.

During closing, when the whole vacuum switching apparatus 22 assembly moves to the initial closed position (FIG. 6), the internal arcing contacts touch and the internal electrode 106 is compressed by the push (pull) rod 64. The disc spring 114 is pre-compacted and provides the initial contact force to the arcing contacts, in order to avoid welding. When the movable external electrode 104 touches the fixed current carrying contact 59, most of the closing current will be transferred to the external electrode 104. The resistance of the whole assembly is low enough for relatively high current.

During opening, the external current carrying contacts open first, and short circuit current is transferred to the internal arcing contacts, which still have enough contact force (e.g., this force can be suitably adjusted by the selection of the disc spring 114), in order to avoid welding. When the internal arcing contacts open, a vacuum arc starts and functions in the same manner as a vacuum arc of conventional AMF vacuum interrupter contacts.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A vacuum switching apparatus comprising:

a vacuum envelope;

a fixed contact assembly partially within said vacuum envelope;

a first movable contact assembly partially within said vacuum envelope;

a second movable contact assembly partially within said vacuum envelope;

a first bellows within said vacuum envelope and cooperating with said first movable contact assembly to maintain a partial vacuum within said vacuum envelope; and a second bellows within said vacuum envelope and cooperating with said first movable contact assembly and said second movable contact assembly to maintain a partial vacuum within said vacuum envelope.

2. The vacuum switching apparatus of claim 1 wherein said first movable contact assembly comprises a first movable contact within said vacuum envelope and a first movable contact stem partially within said vacuum envelope; wherein said vacuum envelope includes an opening; wherein said first movable contact stem passes through the opening of said vacuum envelope; and wherein said first bellows includes a first end coupled to said vacuum envelope proximate the opening thereof and a second end coupled to one of said first and second movable contact stems within said vacuum envelope.

3. The vacuum switching apparatus of claim 2 wherein said second movable contact assembly comprises a second movable contact within said vacuum envelope and a second movable contact stem partially within said vacuum envelope; wherein said second movable contact is concentric with said first movable contact; wherein said second movable contact stem is concentric with said first movable contact stem; wherein said second movable contact stem passes through the opening of said vacuum envelope; and wherein said second bellows includes a first end coupled to said first movable contact stem within said vacuum envelope and a second end coupled to said second movable contact stem within said vacuum envelope.

4. The vacuum switching apparatus of claim 1 wherein said first movable contact assembly comprises a first movable contact and a first movable contact stem; wherein said second movable contact assembly comprises a second movable contact and a second movable contact stem; wherein said first and second movable contacts electrically engage said fixed contact assembly within said vacuum envelope in a first contact position; wherein said second movable contact electrically engages said fixed contact assembly within said vacuum envelope and said first movable contact is electrically disengaged from said fixed contact assembly within said vacuum envelope in a second contact position; and wherein said first and second movable contacts are electrically disengaged from said fixed contact assembly within said vacuum envelope in a third contact position.

5. The vacuum switching apparatus of claim 4 wherein said second movable contact is structured to provide an arcing contact; and wherein said first movable contact is structured to provide a current carrying contact.

6. The vacuum switching apparatus of claim 5 wherein said current carrying contact is made of a first material having a first conductivity, a first permittivity and a first erosion resistance; wherein said arcing contact is made of a second different material having a second conductivity, a second permittivity and a second erosion resistance; wherein said first conductivity is greater than said second conductivity; wherein said first permittivity is less than said second permittivity; and wherein said first erosion resistance is less than said second erosion resistance.

7. The vacuum switching apparatus of claim 4 wherein said second movable contact is concentric with said first movable contact; and wherein said second movable contact stem is concentric with said first movable contact stem.

8. The vacuum switching apparatus of claim 7 wherein said first movable contact is disposed around said second movable contact and is structured to provide an arcing contact; and wherein said second movable contact is structured to provide a current carrying contact.

9. The vacuum switching apparatus of claim 8 wherein said first movable contact stem includes a magnetic field coil disposed therein.

10. The vacuum switching apparatus of claim 7 wherein said first movable contact is disposed around said second movable contact and is structured to provide a current carrying contact; and wherein said second movable contact is structured to provide an arcing contact.

11. The vacuum switching apparatus of claim 10 wherein said second movable contact assembly further comprises a magnetic field coil disposed between said second movable contact stem and said second movable contact; and wherein said fixed contact assembly comprises a fixed contact within said vacuum envelope, a fixed contact stem partially within said vacuum envelope, and a magnetic field coil disposed between said fixed contact stem and said fixed contact within said vacuum envelope.

12. A vacuum switching apparatus comprising:

a vacuum envelope;

a fixed contact assembly partially within said vacuum envelope;

a first movable contact assembly partially within said vacuum envelope;

a second movable contact assembly partially within said vacuum envelope;

a first bellows within said vacuum envelope and cooperating with said first movable contact assembly to maintain a partial vacuum within said vacuum envelope;

a second bellows within said vacuum envelope and cooperating with said first movable contact assembly and said second movable contact assembly to maintain a partial vacuum within said vacuum envelope; and an operating assembly cooperating with said first and second movable contact assemblies to provide one of a first contact position wherein said first and second movable contact assemblies electrically engage said fixed contact assembly within said vacuum envelope, a second contact position wherein said second movable contact assembly electrically engages said fixed contact assembly within said vacuum envelope and said first movable contact assembly is electrically disengaged from said fixed contact assembly within said vacuum envelope, and a third contact position wherein said first and second movable contact assemblies are electrically disengaged from said fixed contact assembly within said vacuum envelope.

13. The vacuum switching apparatus of claim 12 wherein said operating assembly comprises a dual contact spring assembly outside of said vacuum envelope; wherein said first movable contact assembly comprises a first movable contact within said vacuum envelope and a first movable contact stem partially within said vacuum envelope; wherein said second movable contact assembly comprises a second movable contact within said vacuum envelope and a second movable contact stem partially within said vacuum envelope; wherein said dual contact spring assembly comprises a first contact spring and a second contact spring; wherein said first contact spring engages said first movable contact stem; and wherein said second contact spring engages said second movable contact stem.

14. The vacuum switching apparatus of claim 12 wherein said operating assembly comprises a dual contact spring assembly outside of said vacuum envelope; wherein said first movable contact assembly comprises a first movable contact within said vacuum envelope and a first movable contact stem partially within said vacuum envelope; wherein said second movable contact assembly comprises a second movable contact within said vacuum envelope and a second movable contact stem partially within said vacuum envelope; wherein said second movable contact is concentric with said first movable contact; wherein said second movable contact stem is concentric with said first movable contact stem; wherein said dual contact spring assembly comprises a housing housing a first contact spring and a second contact spring; wherein said second contact spring is concentric with said first contact spring; wherein said first contact spring engages said first movable contact stem outside of said vacuum envelope; and wherein said second contact spring engages said second movable contact stem outside of said vacuum envelope.

15. The vacuum switching apparatus of claim 14 wherein said first movable contact stem includes a first longitudinal opening therethrough; wherein said second movable contact stem includes a second longitudinal opening therethrough; wherein said second movable contact stem is disposed in said first longitudinal opening; and wherein a heat pipe is disposed in said second longitudinal opening.

16. The vacuum switching apparatus of claim 12 wherein a shunt is electrically connected in parallel with said second bellows; wherein said shunt includes a first resistance; wherein said second bellows includes a second resistance; and wherein said first resistance is less than said second resistance.

17. The vacuum switching apparatus of claim 12 wherein said second movable contact assembly comprises a movable contact within said vacuum envelope and a movable contact stem partially within said vacuum envelope; and wherein said operating assembly comprises an electrical connection to one of said first and second movable contact stems outside of said vacuum envelope.

18. The vacuum switching apparatus of claim 12 wherein said first contact position provides a closed position of said vacuum switching apparatus; wherein movement from said first contact position to said second contact position provides a transition from conduction to arcing between said fixed contact assembly and said second movable contact assembly; wherein movement from said third contact position to said second contact position provides a transition from non-conduction to arcing between said fixed contact assembly and said second movable contact assembly; and wherein said third contact position provides an open position of said vacuum switching apparatus.

19. The vacuum switching apparatus of claim 12 wherein said first movable contact assembly is disposed around said second movable contact assembly and is structured to provide an arcing contact; wherein said second movable contact assembly is structured to provide a current carrying contact; and wherein said first movable contact assembly comprises a magnetic field coil.

20. The vacuum switching apparatus of claim 12 wherein said first movable contact assembly is disposed around said second movable contact assembly and is structured to provide a current carrying contact within said vacuum envelope; wherein said second movable contact assembly is structured to provide an arcing contact within said vacuum envelope; wherein said second movable contact assembly comprises a magnetic field coil within said vacuum envelope, a movable contact stem partially within said vacuum envelope, and said arcing contact within said vacuum envelope, said magnetic field coil being between said movable contact stem and said arcing contact; and wherein said fixed contact assembly comprises a fixed contact within said vacuum envelope, a fixed contact stem partially within said vacuum envelope, and a magnetic field coil disposed between said fixed contact stem and said fixed contact within said vacuum envelope.

21. The vacuum switching apparatus of claim 12 wherein said first movable contact assembly comprises a first movable contact within said vacuum envelope and a first movable contact stem partially within said vacuum envelope; wherein said second movable contact assembly comprises a second movable contact within said vacuum envelope and a second movable contact stem partially within said vacuum envelope; wherein said second movable contact is concentric with said first movable contact; wherein said second movable contact stem is concentric with said first movable contact stem; and wherein a number of washers is placed into a gap between said first and second movable contact stems in order to the maintain concentricty during movement between the first, second and third contact positions.

22. A vacuum electrical switching apparatus comprising:

a vacuum switching apparatus comprising:

a vacuum envelope, a fixed contact assembly partially within said vacuum envelope, a first movable contact assembly partially within said vacuum envelope, a second movable contact assembly partially within said vacuum envelope, a first bellows within said vacuum envelope and cooperating with said first movable contact assembly to maintain a partial vacuum within said vacuum envelope, a second bellows within said vacuum envelope and cooperating with said first movable contact assembly and said second movable contact assembly to maintain a partial vacuum within said vacuum envelope, and an operating assembly cooperating with said first and second movable contact assemblies to provide one of a first contact position wherein said first and second movable contact assemblies electrically engage said fixed contact assembly within said vacuum envelope, a second contact position wherein said second movable contact assembly electrically engages said fixed contact assembly within said vacuum envelope and said first movable contact assembly is electrically disengaged from said fixed contact assembly within said vacuum envelope, and a third contact position wherein said first and second movable contact assemblies are electrically disengaged from said fixed contact assembly within said vacuum envelope; and an operating mechanism structured to move said operating assembly in a first longitudinal direction and an opposite second longitudinal direction.

23. The vacuum electrical switching apparatus of claim 22 wherein said operating assembly comprises a longitudinal member structured to be moved in a first longitudinal direction and an opposite second longitudinal direction by said operating mechanism.

24. The vacuum electrical switching apparatus of claim 23 wherein said operating mechanism is a one-step operating mechanism structured to move said longitudinal member in one of the first and second longitudinal directions; and wherein said operating assembly further comprises a dual contact spring assembly structured to transition said first and second movable contact assemblies in two steps from either of: the first contact position to the third contact position through the second contact position, or the third contact position to the first contact position through the second contact position.

* * * * *